US008054156B2

(12) United States Patent
Fort et al.

(10) Patent No.: US 8,054,156 B2
(45) Date of Patent: Nov. 8, 2011

(54) LOW VARIATION RESISTOR

(75) Inventors: Jimmy Fort, Aix en Provence (FR); Michel Cuenca, Septemes-les-Vallons (FR)

(73) Assignee: Atmel Corporation, San Jose, CA (US)

( * ) Notice: Subject to any disclaimer, the term of this patent is extended or adjusted under 35 U.S.C. 154(b) by 743 days.

(21) Appl. No.: 12/198,643

(22) Filed: Aug. 26, 2008

(65) Prior Publication Data

US 2010/0052840 A1 Mar. 4, 2010

(51) Int. Cl.
*H01C 7/06* (2006.01)

(52) U.S. Cl. ..... 338/7; 338/333; 327/563; 327/513; 323/313

(58) Field of Classification Search ..... 338/7, 22 R, 338/22 SD, 333, 334; 323/313, 314; 327/563, 327/103, 67, 513; 374/101, 163; 361/103
See application file for complete search history.

(56) References Cited

U.S. PATENT DOCUMENTS

| | | | |
|---|---|---|---|
| 4,622,476 | A | 11/1986 | Venkatesh |
| 4,868,482 | A | 9/1989 | O'Shaughnessy et al. |
| 5,345,118 | A | 9/1994 | White et al. |
| 5,982,201 | A | 11/1999 | Brokaw et al. |
| 6,388,507 | B1 | 5/2002 | Hwang et al. |
| 6,400,252 | B1 | 6/2002 | Smith et al. |
| 7,224,210 | B2 | 5/2007 | Garlapati et al. |

*Primary Examiner* — Kyung Lee
(74) *Attorney, Agent, or Firm* — Fish & Richardson P.C.

(57) ABSTRACT

This document discloses low variation resistor devices, methods, systems, and methods of manufacturing the same. In some implementations, a low-variation resistor can be implemented with a metal-oxide-semiconductor field-effect-transistor ("MOSFET") operating in the triode (e.g., ohmic) region. The MOSFET can have a source that is connected to a reference voltage (e.g., ground) and a gate connected to a gate voltage source. The gate voltage source can generate a gate voltage that varies in proportion to changes in the temperature of an operating environment. The gate voltage variation can, for example, be controlled so that it offsets the changes in MOSFET resistance that are caused by changes in temperature. In some implementations, the gate voltage variation offsets the resistance variance by offsetting changes in transistor mobility that are caused by changes in temperature.

27 Claims, 3 Drawing Sheets

LOW VARIATION RESISTOR

TECHNICAL FIELD

This specification relates to semiconductor devices.

BACKGROUND

Resistors can be used in analog electronics to achieve a desired voltage in an electrical circuit, limit current flow through a portion of an electrical circuit and can be configured as voltage dividers. Resistors have a specified resistance (e.g., 100 ohms) and a tolerance (e.g., 20%) that define the characteristics of the resistor. For example a resistor that has a specified resistance of 100 ohms and a tolerance of 20%, can have an actual resistance that varies from 80 ohms to 120 ohms. The variation of the actual resistance can depend, for example, on the characteristics of the resistor (e.g., composition material) as well as the environment in which the resistor operates.

In some situations, the temperature of the environment in which the resistor operates can affect the actual resistance of a resistor. For example, as the temperature varies, the actual resistance of the resistor can vary relative to the temperature. In turn, the current flowing through the resistor and the voltage drop across the resistor can vary in proportion to the actual resistance. Thus, in some operating environments it can be difficult to maintain an actual resistance that is stable over a range of operating temperatures.

SUMMARY

This document discloses low variation resistor devices, methods, systems, and methods of manufacturing the same. In some implementations, a low-variation resistor can be implemented with a metal-oxide-semiconductor field-effect-transistor ("MOSFET") operating in the triode (e.g., ohmic) region. The MOSFET can have a source that is connected to a reference voltage (e.g., ground) and a gate connected to a gate voltage source. The gate voltage source can generate a gate voltage that varies in proportion to changes in the temperature of an operating environment. The gate voltage variation can, for example, be controlled so that it offsets the changes in MOSFET resistance that are caused by changes in temperature. In some implementations, the gate voltage variation offsets the resistance variance by offsetting changes in transistor mobility that are caused by changes in temperature.

Implementations may include one or more of the following features and/or advantages. A low-variation resistor can be implemented in an integrated circuit. The low-variation resistor can be implemented as a MOSFET. Constant current can be maintained in an operating environment that has a variable temperature.

The details of one or more embodiments of the subject matter described in this specification are set forth in the accompanying drawings and the description below. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

§1.0 Example Low Variation MOS Resistor System

Figure 1:
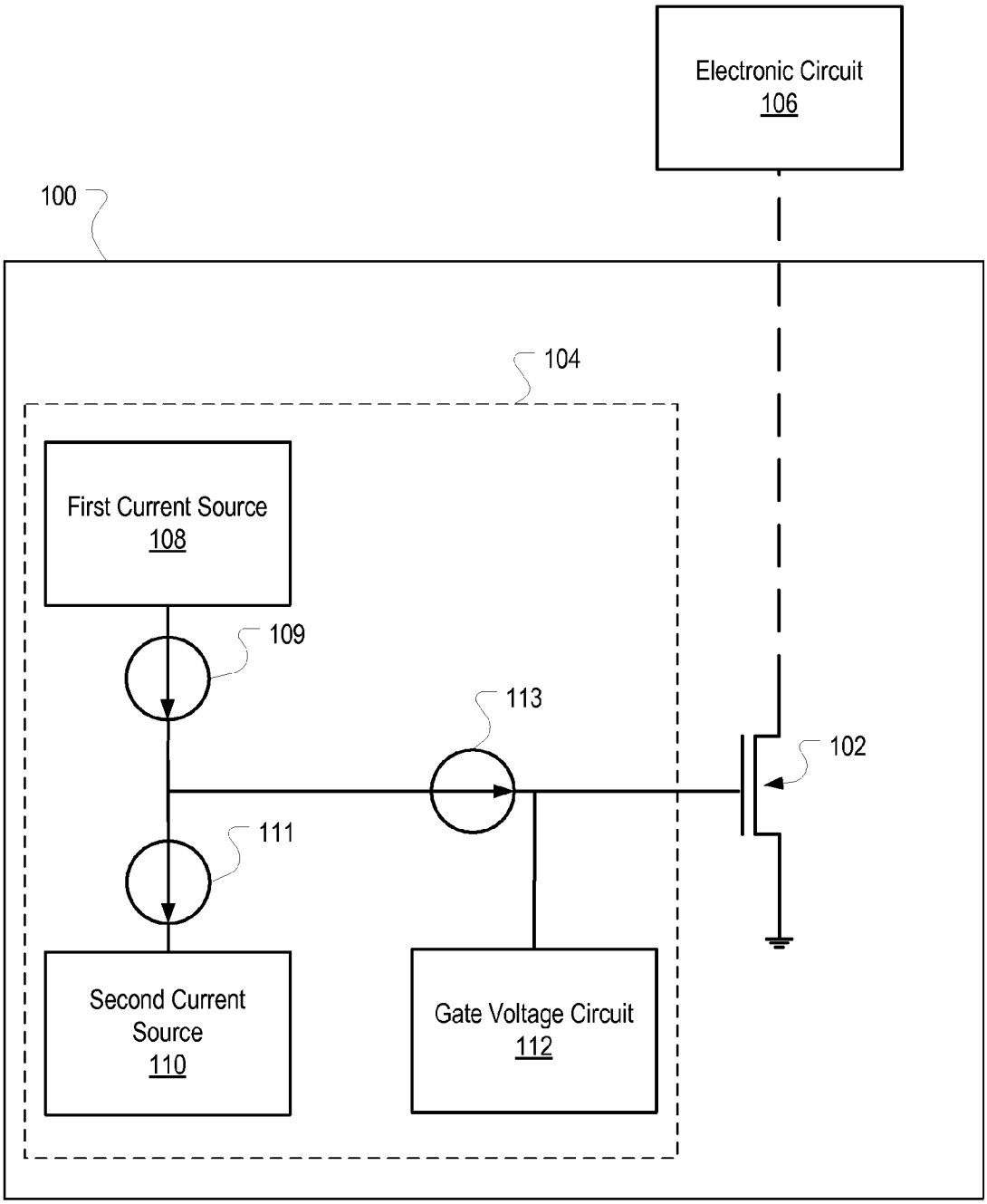
FIG. 1 is a block diagram of an example low variation MOS resistor system.

FIG. 1 is a block diagram of an example low-variation metal-oxide-semiconductor ("MOS") resistor system ("system") 100. The system 100 can include a MOS resistor 102 and a temperature dependent voltage source 104. The system 100 can be coupled, for example, to an electronic circuit 106 to produce a low variation current for the electronic circuit 106. In turn, the low variation current can be used to create a low variation voltage in the electronic circuit 106. In some implementations, the MOS resistor 102 can be a MOSFET that is operating in the triode (e.g., ohmic) region. The MOS resistor 102 can be, for example, an n-channel MOSFET.

MOSFETs operate in the triode region when the voltage difference between the gate and source of the MOSFET exceeds a threshold voltage but the drain to source voltage does not exceed the difference between the gate to source voltage and a threshold voltage ($V_t$). A MOSFET operating in the triode region has electrical characteristics similar to a resistor. The actual resistance of a MOSFET in triode is dependent on the gate to source voltage and the characteristics of the MOSFET. For example, as the gate voltage increases relative to the source voltage, the resistance of an n-channel MOSFET decreases. Similarly, the actual resistance of a MOSFET is dependent on the MOSFET oxide capacitance ($C_{ox}$). For example, an increased oxide capacitance can increase the resistance of the n-channel MOSFET. The resistance of an n-channel MOSFET operating in triode region can be determined according to Equation 1.

$$R=(\mu C_{ox}N(V_{gs}-V_t))^{-1}, \quad (1)$$

where, $\mu$ is the mobility of the MOSFET;

$C_{ox}$ is the oxide capacitance of the MOSFET;

N is a size ratio (e.g., Width/Length) of the MOSFET;

$V_{gs}$ is the gate to source voltage of the MOSFET; and $V_t$ is the threshold voltage of the MOSFET.

The oxide capacitance of the MOSFET ($C_{ox}$) is dependent on the process by which the MOSFET is fabricated. For example, the thickness and quality of the oxide that is grown on a semiconductor substrate can have an effect of the capacitance of the oxide layer. Similarly, the size ratio (N) of the MOSFET is dependent on the width and length of the MOSFET, as fabricated. For example, a MOSFET having a higher size ratio will have a smaller resistance than a MOSFET having a lower size ratio. However, the temperature of the operating environment has no effect on the oxide capacitance or size ratio of a MOSFET.

The gate to source voltage ($V_{gs}$) is not directly dependent on temperature, but can be expressed as a function of temperature. For example, the gate to source voltage can be expressed as $V_{gs}=V_b+V_t$, where $V_t$ is the threshold voltage, and $V_b$ is a bias voltage. The threshold voltage is a temperature dependent parameter of a MOSFET, and, in turn, a temperature dependent parameter of the gate to source voltage. For example, when the temperature of the operating environment increases, the threshold voltage of the MOSFET decreases. However, if the alternative expression of $V_{gs}$ (e.g., $V_b+V_t$) is substituted in Equation 1, the threshold voltage ($V_t$) term is offset by the negative threshold voltage ($-V_t$) term, thereby removing the temperature dependence from the gate to source voltage. Thus, Equation 1 can be reduced to the expression in Equation 2.

$$R=(\mu C_{ox}N(V_b))^{-1} \quad (2)$$

The mobility (μ) of a MOSFET is a temperature dependent parameter. Thus, changes in the temperature of the operating environment can affect the mobility of the MOSFET and, in turn, the resistance of the MOSFET. Based on Equation 2 and the discussion above, the mobility of the MOSFET is the only temperature dependent parameter that has an effect on the resistance of the MOSFET. Therefore, offsetting changes in the mobility parameter, due to changes in the temperature of the operating environment, can reduce the variation of the MOSFET resistance.

In some implementations, the temperature dependence of the mobility can be offset by adjusting the bias voltage of the MOS resistor 102. According to Equation 2, when the mobility of the MOS resistor 102 increases due to a decrease in the operating temperature, a stable resistance can be maintained by reducing the bias voltage ($V_b$). For example, if the mobility increases by a factor of two, the bias voltage can be adjusted by a factor of ½, thereby offsetting the increased mobility and maintaining a stable resistance.

The bias voltage can be adjusted by adjusting the gate to source voltage. In some implementations, a reference voltage (e.g., ground) can be applied to the source of the MOS resistor 102, such that the gate to source voltage of the MOS resistor 102 can be adjusted based solely on the voltage that is applied to the gate of the MOS resistor 102.

In some implementations, the voltage that is applied to the gate of the MOS resistor 102 can be defined by a temperature dependent voltage source 104. The temperature dependent voltage source 104 can include a first current source 108, a second current source 1 10, and a gate voltage circuit 1 12. The first current source 108 can generate a first output current 109 that has a positive temperature coefficient (e.g., proportional to absolute temperature). Therefore, an increase in the absolute temperature of the operating environment will result in an increase in the first output current 109. Similarly, a decrease in the absolute temperature of the operating environment will result in a decrease in the first output current 109.

The second current source 110 can generate a second output current 111 that has a negative temperature coefficient (e.g., complementary to absolute temperature change). Therefore, a decrease in the absolute temperature of the operating environment will result in an increase in the second output current 111. Similarly, an increase in the absolute temperature of the operating environment will result in a decrease in the second output current 111.

In some implementations, a bias current 113 can be generated based on the first output current 109 and the second output current 111. The bias current 113 can be, for example, the difference between the first output current 109 and the second output current 111. The bias current 113 can be applied to the gate voltage circuit 112 to generate a gate voltage at the gate of the MOS resistor 102. In turn, the current 113 can flow through the gate voltage circuit 112 to ground, thereby generating a voltage drop across the gate voltage circuit 112. The voltage drop across the gate voltage circuit 112 is the gate voltage that is applied to the gate of the MOS resistor 102.

As discussed, the first output current 109 and the second output current 111 both vary based on the temperature of the operating environment. However, the change in the bias current 113 over a temperature range is greater than the change of either output currents 109 or 111, individually, because the first output current 109 and the second output current 111 vary inversely to each other. For example, when the temperature of the operating environment increases, the first output current 109 increases, while the second output current 111 decreases. Therefore, the change in the bias current 113 will be the sum of the absolute change in the first output current 109 and the second output current 111. This relationship is illustrated by Equation 3.

$$I_p=(I_{P0}+x)-(I_{c0}+y) \quad (3)$$

where, $I_b$ is the bias current;

$I_{p0}$ is the first output current at a reference temperature;

x is the change in the first output current due to the temperature change;

$I_{c0}$ is the second output current at the reference temperature;

y is the change in the second output current due to the temperature change;

x is positive when y is negative; and y is positive when x is negative.

Referring again to the example in FIG. 1, when the first output current 109, the second output current 111, and the bias current 113 are plotted on a graph relative to the temperature of the operating environment, the bias current 113 will have the greatest slope. The gate voltage that is generated by the gate voltage circuit 112 is proportionate to the current 113 (e.g., gate voltage=bias current*impedance of the gate voltage circuit). Thus, the slope of the gate voltage relative to temperature has a slope that is proportional to the slope of bias current 113.

In some implementations, the slope of the bias voltage Vb relative to the temperature variation can approximate the negative of the slope of the mobility. In these implementations, the complementary relationship between the slope of the mobility and the slope of the gate voltage can result in a MOS resistor 102 that has a low variation resistance. For example, when the mobility has a slope of approximately two, the mobility will increase by a factor of two for each unit decrease in temperature (e.g., 2μ). In this example, a gate voltage can be generated that has a slope of approximately negative two; such that for each unit decrease in temperature, the gate voltage will decrease by a factor of two (e.g., gate voltage/2). Thus, the product of the gate voltage and the mobility will remain approximately uniform over the operating temperature (e.g., (μ*2)*(gate voltage/2)=μ*gate voltage). Accordingly, based on Equation 2, the resistance of the MOS resistor 102 will remain stable over temperature variations because the temperature dependence of the mobility is offset by adjusting the gate voltage.

§2.0 Example Schematic of a Low Variation MOS Resistor System

Figure 2:
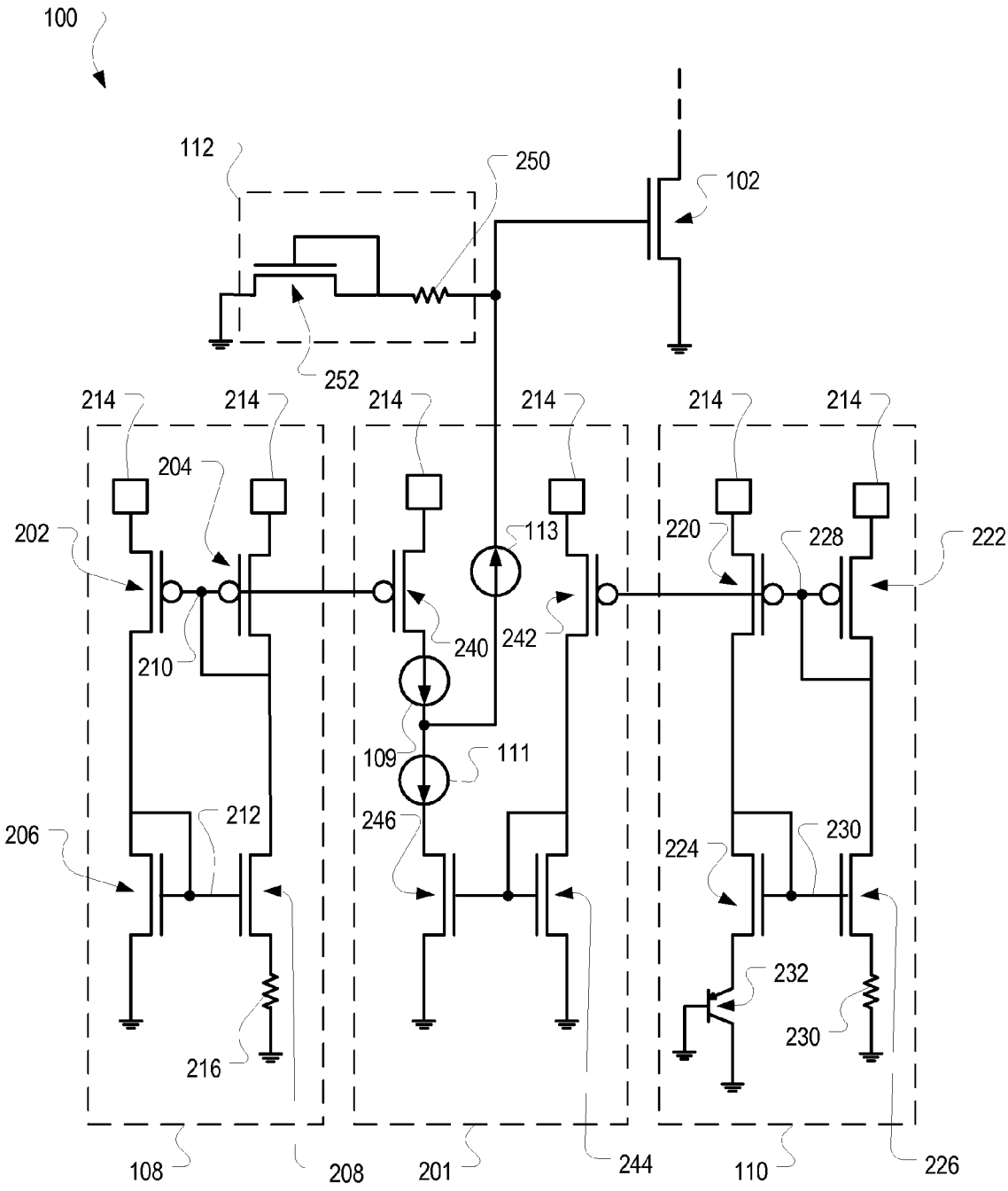
FIG. 2 is a schematic of an example low variation MOS resistor system.

FIG. 2 is an example schematic of a low variation MOS resistor system 100. As discussed above, the system 100 can include a MOS resistor 102, a first current source 108, a second current source 110, and a gate voltage circuit 112. In some implementations, the system 100 can also include a coupling circuit 201.

In some implementations, the first current source 108 can be configured to include MOSFET transistors 202, 204, 206, and 208, configured as shown in FIG. 2. Transistors 202 and 204 can be p-channel MOS transistors that have a common gate 210, while transistors 206 and 208 can be n-channel MOS transistors that have a common gate 212. The sources of the transistors 202 and 204 can be connected to a supply voltage 214. The common gate 210 can be connected, for example, to the drains of transistors 204 and 208. Similarly, the common gate 212 can be connected to the drains of transistors 202 and 206. The drains of transistors 202 and 204 can be connected to the drains of corresponding transistors 206 and 208, respectively. The source of transistor 206 can be connected to ground, while the source of the transistor 208 can be coupled to ground by a first resistor 216.

As configured in FIG. 2, the transistors 202 and 204 are biased on (e.g., operating in saturation), while the transistors 206 and 208 are biased to operate in weak inversion. The first output current 109 generated by the first current source 108 can be defined by the first resistor 216. The magnitude of the first output current 109 can be provided, for example, by Equation 4.

$$I_p = \frac{nU_t \ln(D)}{R_b} \tag{4}$$

where, $I_p$ is the first output current;

n is a slope of the transistor in weak inversion;

D is a sizing ratio of transistors (e.g., $N_{208}/N_{206}$);

$U_t$=kT/q; and $R_b$ is the first resistor.

where, k is a Boltzmann constant;

T is the temperature of the operating environment; and q is the charge of an electron.

According to Equation 3, the first output current 109 has a positive temperature coefficient $U_t$ (e.g., kT/q). Therefore, as discussed above, the first output current 109 varies in direct proportion to the temperature of the operating environment. For example, if the temperature of the operating environment increases, the first output current 109 also increases.

In some implementations, the second current source 110 can be configured in a similar manner as the first current source 108. For example, MOSFET transistors 220, 222, 224, and 226 can be configured as shown in FIG. 2. Transistors 220 and 222 can be p-channel MOS transistors that have a common gate 228, while transistors 224 and 226 can be n-channel MOS transistors that have a common gate 230. The sources of the transistors 220 and 222 can be connected to the supply voltage 214. The common gate 228 can be connected, for example, to the drains of transistor 222 and 226. Similarly, the common gate 230 can be connected to the drains of transistors 220 and 224. The drains of transistors 220 and 222 can be connected to the drains of corresponding transistors 224 and 226, respectively. The source of transistor 226 can be coupled to ground by a second resistor 230. Transistor 224 can be connected to the emitter of a bipolar junction transistor 232 that has its collector connected to ground.

As configured in FIG. 2, the transistors 220 and 222 are biased on (e.g., saturation), while the transistors 224 and 226 are biased to operate in weak inversion. The second output current 111 generated by the second current source 110 can be defined by the second resistor 230 and the base to emitter voltage ($V_{be}$) of the transistor 232. The magnitude of the second output current 111 can be provided, for example, by Equation 5.

$$I_c = \frac{V_{be}}{R} \tag{5}$$

where, $I_c$ is the second output current;

$V_{be}$ is the base to emitter voltage of transistor; and

R is the resistance of the second resistor.

Thus, the variation of the second output current 111 depends on the variation of the base to emitter voltage of the transistor 232. The base to emitter voltage can vary with the temperature of the operating environment. For example, a base to emitter voltage variation for a bipolar transistor is approximately −2.2 mV/degree Celsius. Accordingly, for each one degree Celsius increase in the temperature of the operating environment, the base to emitter voltage will decrease by about 2.2 mV. Thus, the second output current 111 has a negative temperature coefficient.

In some implementations, a coupling circuit 201 can be used to generate the bias current 113. As discussed, the bias current 113 can have a magnitude that is equal to the difference between the first output current 109 and the second output current 111 (e.g., first output current 109—second output current 111). For example, the coupling circuit 201 can include a transistor 240 that has its source connected to the supply voltage 214, and its gate connected to common gate 210. In this configuration, transistor 240 operates as a current mirror to provide the first output current 109 at the drain of the transistor 240.

The coupling circuit 201 can also include transistors 242, 244, and 246 to provide the second output current at the drain of transistor 246. As shown in FIG. 2, the source of transistor 242 is connected to the supply voltage 214, while its gate is connected to the common gate 228. In this configuration, transistor 242 operates as a current mirror to provide the second output current 111 at the drain of transistor 242. The drain of transistor 242 is connected to the drain of transistor 244. The drain of transistor 244 is connected to the gate of transistor 244, which is, in turn, connected to the gate of transistor 246. The sources of transistors 244 and 246 are connected to a reference voltage (e.g., ground) and the drain of transistor 246 is connected to the drain of transistor 240. In this configuration, the second output current 111 is provided at the drain of transistor 246. Thus, the bias current 113 flowing out of the coupling circuit 201 is equal to the difference between the first output current 109 and the second output current 111. The bias current 113 flows through the gate voltage circuit 112 to ground to generate the voltage that is applied to the gate of the MOS resistor 102.

In some implementations, the gate voltage circuit 112 can include a third resistor 250 and a transistor 252. The transistor 252 can have its source connected to a reference voltage (e.g., ground) and its gate and drain connected to the third resistor 250. In this configuration, the transistor 252 operates as a diode that is turned on when the gate to source voltage is at least equal to the threshold voltage of the transistor 252. When the transistor 252 turns on, current flows through the transistor 252 and the third resistor 250. The voltage drop across the third resistor 250 and the transistor 252 is equal to the voltage that is applied to the gate of the MOS resistor 102.

The voltage drop across the transistor 252 is equal to the threshold voltage because the source and gate of the transistor 252 are connected and sizing is done in this way. Therefore, the voltage drop across the third resistor 250 is equal to the difference between the gate voltage and the threshold voltage.

As discussed above, the gate to source voltage of the MOS resistor 102 is equal to the sum of the threshold voltage and the bias voltage. Therefore, when the source of the MOS resistor 102 is connected to ground, the gate voltage of the MOS resistor 102 is equal to the sum of the threshold voltage and the bias voltage. In turn, the voltage drop across the gate voltage circuit 112 is also equal to the sum of the threshold voltage and the bias voltage. Therefore, the voltage drop across the third resistor 250 is equal to the bias voltage because the voltage drop across the transistor 252 is equal to the threshold voltage. Accordingly, adjusting the bias current 113 through the bias resistor 250 adjusts the gate voltage of the MOS resistor 102.

As discussed, the bias current 113 can be generated so that the slope of the bias current 113 over temperature variation can be in complement with the mobility of the MOS resistor 102. Because the bias voltage $V_b$ generated by the gate voltage circuit 112 is proportional to the bias current 113, the gate voltage can have a slope over temperature that is in complement with the mobility of the MOS resistor 102. Therefore, the temperature dependence of the mobility of the MOS resistor 102 can be offset by the change in the gate voltage generated by the gate voltage circuit 112. Accordingly, the resistance of the MOS resistor 102 can be stabilized over a range of operating temperatures. Thus, the system 102 can be used to provide a low variation current to an electronic circuit.

§3.0 Example Process Flow

Figure 3:
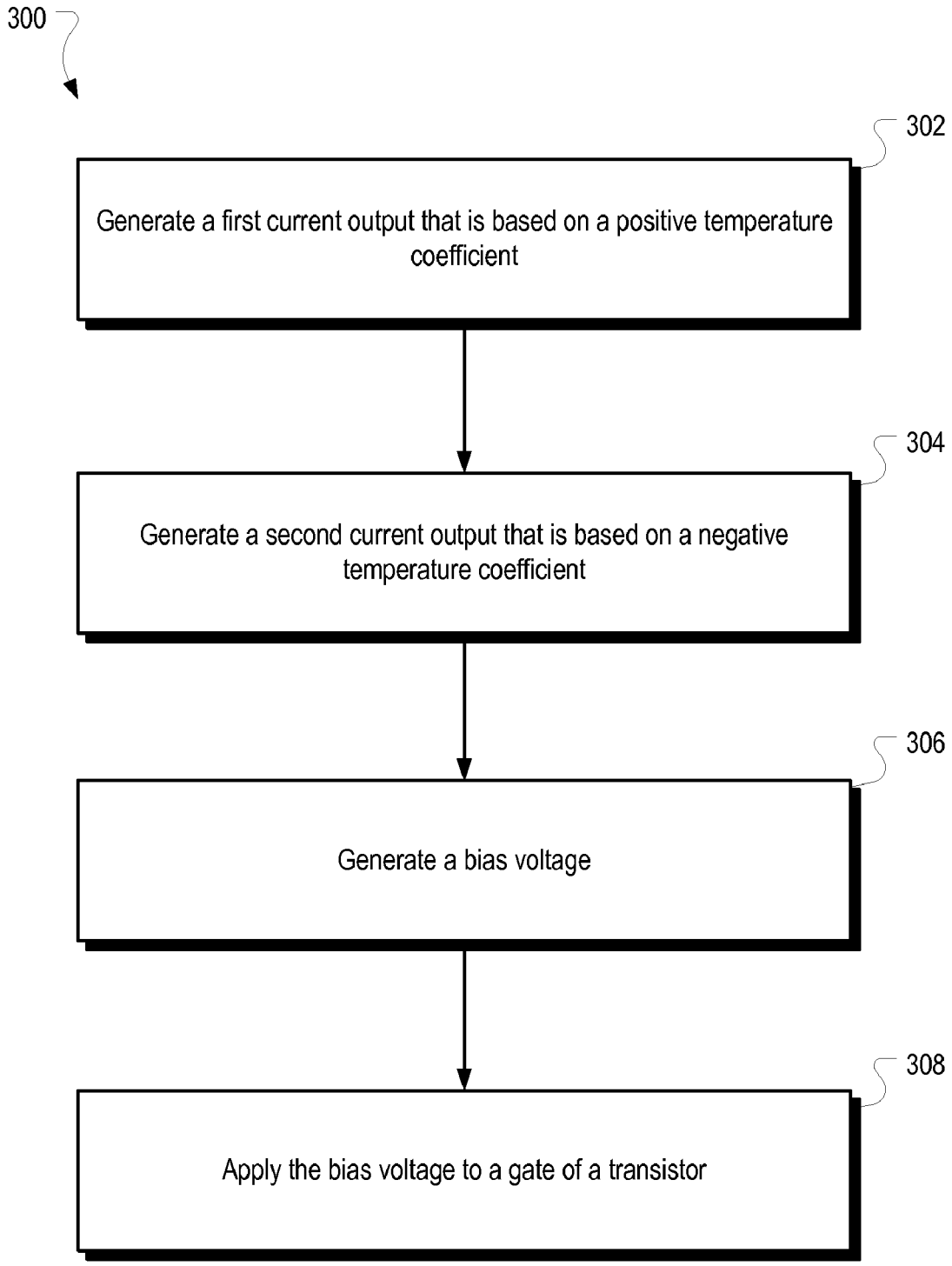
FIG. 3 is a flow chart of an example process of controlling MOS resistor variation.

FIG. 3 is a flow chart of an example process 300 of controlling MOS resistor variation. In some implementations, the process 300 can adjust the voltage that is applied to the gate of a transistor to offset the effects of temperature variation on the resistance of the transistor. The process 300 can be implemented, for example, by the system 100.

Stage 302 generates a first output current that is based on a positive temperature coefficient. For example, the first output current can increase when the temperature of the operating environment increases. The first output current can be generated, for example, by the first current source 108.

Stage 304 generates a second output current that is based on a negative temperature coefficient. For example, the second output current can decrease when the temperature of the operating environment increases. The second output current can be generated, for example, by the second current source 110.

Stage 306 generates a bias voltage. In some implementations, the bias voltage can be based on a difference in magnitude between the first current source and the second current source. In some implementations, the bias voltage can have a magnitude that varies based on a mobility characteristic of a transistor. The bias voltage can be generated, for example, by the gate voltage circuit 112.

Stage 308 applies the bias voltage to a gate of a transistor. In some implementations, the bias voltage can bias the transistor to offset the temperature effects on the resistance across the channel of the transistor. The bias voltage can be applied to the gate, for example, by the gate voltage circuit 112.

While this document contains many specific implementation details, these should not be construed as limitations on the scope of what may be claimed, but rather as descriptions of features that may be specific to particular embodiments. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while process steps are depicted in the drawings in a particular order, this should not be understood as requiring that such process steps be performed in the particular order shown or in sequential order, or that all illustrated process steps be performed, to achieve desirable results.

Particular embodiments of the subject matter described in this specification have been described. Other embodiments are within the scope of the following claims. For example, the actions recited in the claims can be performed in a different order and still achieve desirable results. As one example, the processes depicted in the accompanying figures do not necessarily require the particular order shown, or sequential order, to achieve desirable results.

What is claimed is:

1. A resistor system, comprising:

a first transistor including a first terminal, a second terminal, and a third terminal, the third terminal connected to a reference voltage;

a temperature dependent biasing source connected to the first terminal, the temperature dependent biasing source comprising:

a first current source having a first output current that is based on a positive temperature coefficient;

a second current source coupled to the first current source, the second current source having a second output current that is based on a negative temperature coefficient; and a resistive circuit coupled to the first current source, the second current source, and the first terminal of the transistor, the resistive circuit providing a temperature dependent first terminal voltage to the first terminal of the first transistor.

2. The system of claim 1, wherein the first terminal is a first gate, the second terminal is a first drain, the third terminal is a first source, and the first terminal voltage is a gate voltage.

3. The system of claim 2, wherein the gate voltage is based on a difference in magnitude between the first output current and the second output current.

4. The system of claim 1, wherein the first current source comprises:

a first transistor pair coupled to a supply voltage; and a second transistor pair coupled to the first transistor pair.

5. The system of claim 4, wherein the first transistor pair comprises:

a second transistor including a second source, a second drain, and a second gate; and a third transistor including a third source, a third drain, and a third gate, the third gate coupled to the second gate and the third drain.

6. The system of claim 5, wherein the second transistor pair comprises:

a fourth transistor including a fourth source, a fourth drain, and a fourth gate, the fourth drain coupled to the third drain, the fourth source coupled to ground by a first resistor; and a fifth transistor including a fifth source, a fifth drain, and a fifth gate, the fifth gate coupled to the fourth gate and the fifth drain.

7. The system of claim 6, wherein the second transistor and the third transistor are p-channel field effect transistors and the fourth transistor and the fifth transistor are n-channel field effect transistors.

8. The system of claim 4, wherein the second current source comprises:

a first transistor pair coupled to a supply voltage; and a second transistor pair coupled to the first transistor pair.

9. The system of claim 8, wherein the first transistor pair comprises:

a second transistor including a second source, a second drain, and a second gate; and a third transistor including a third source, a third drain, and a third gate, the third gate coupled to the second gate and the third drain.

10. The system of claim 9, wherein the second transistor pair comprises:

a fourth transistor including a fourth source, a fourth drain, and a fourth gate, the fourth drain coupled to the third drain, the fourth source coupled to ground by a second resistor;

a fifth transistor including a fifth source, a fifth drain, and a fifth gate, the fifth gate coupled to the fourth gate and the fifth drain.

11. The system of claim 10, wherein the second transistor and the third transistor are p-channel field effect transistors and the fourth transistor and the fifth transistor are n-channel field effect transistors.

12. The system of claim 10, further comprising a sixth transistor including an emitter, a base, and a collector, the emitter coupled to the fifth source.

13. The system of claim 2, wherein the resistive circuit comprises:

a bias transistor including a source, a gate, and a drain, the source of the transistor coupled to a reference voltage; and a bias resistor having a fourth terminal coupled to the drain and the gate of the bias transistor, and having a fifth terminal coupled to the first current source, the second current source, and the gate of the bias transistor.

14. The system of claim 1, further comprising a coupling circuit coupled to the first current source, the second current source, the resistive circuit, and the first transistor.

15. The system of claim 14, wherein the coupling circuit comprises:

a seventh transistor including a seventh source, a seventh drain, and a seventh gate, the seventh gate coupled to the first current source;

an eighth transistor including an eighth source, an eighth drain, and an eighth gate, the eighth gate coupled to the second current source;

a ninth transistor including a ninth source, a ninth drain, and a ninth gate; and a tenth transistor including a tenth source, a tenth drain, and a tenth gate, the tenth gate being coupled to the ninth gate, the ninth drain, and the eighth drain, the tenth drain coupled to the seventh drain, the resistive circuit, and the gate of the first transistor.

16. A method, comprising:

generating a first output current that is based on a positive temperature coefficient;

generating a second output current that is based on a negative temperature coefficient;

generating a bias voltage based on a difference in magnitude between the first output current and the second output current, the bias voltage having a magnitude that varies based on a mobility characteristic of a transistor; and applying the bias voltage to a terminal of a transistor.

17. The method of claim 16, wherein the mobility characteristic is a mobility variation relative to an operating environment temperature.

18. The method of claim 17, wherein the bias voltage has a magnitude that offsets a change in resistance of the transistor based on the mobility variation relative to the operating environment temperature.

19. The method of claim 16, wherein the terminal is a gate of a metal-oxide-semiconductor transistor.

20. The method of claim 16, further comprising coupling an electronic circuit to the transistor, the electronic circuit operable to perform an operation within a defined operating limit based on the transistor.

21. A device, comprising:

means for generating a first output current that is based on a positive temperature coefficient;

means for generating a second output current that is based on a negative temperature coefficient; and means for biasing a transistor with a temperature dependent voltage that is based on the first output current and the second output current, the temperature dependent voltage having a magnitude that varies based on a mobility characteristic of a transistor.

22. A system for controlling resistance variation of a resistor, comprising:

a transistor biased to function as a resistor;

circuitry coupled to the resistor and operable for:

generating a first output current that is based on a positive temperature coefficient;

generating a second output current that is based on a negative temperature coefficient; and biasing the transistor with a temperature dependent voltage that is based on the first output current and the second output current, the temperature dependent voltage having a magnitude that varies based on a mobility characteristic of a transistor.

23. The method of claim 22, wherein the mobility characteristic is a mobility variation relative to an operating environment temperature.

24. The method of claim 23, wherein the bias voltage has a magnitude that offsets a change in resistance of the transistor based on the mobility variation relative to the operating environment temperature.

25. The system of claim 22, wherein the resistor is a metal-oxide-semiconductor (MOS) resistor.

26. The system of claim 22, further comprising:

an electronic circuit coupled to the resistor and operable for performing an operation within a defined operating limit based on the resistor.

27. The system of claim 22, wherein the resistor is a metal-oxide-semiconductor (MOS) resistor.

* * * * *

UNITED STATES PATENT AND TRADEMARK OFFICE

CERTIFICATE OF CORRECTION

PATENT NO. : 8,054,156 B2
APPLICATION NO. : 12/198643
DATED : November 8, 2011
INVENTOR(S) : Jimmy Fort and Michel Cuenca It is certified that error appears in the above-identified patent and that said Letters Patent is hereby corrected as shown below:

In Column 3, Line 35, delete "1 10," and insert --110,--, therefor.

In Column 3, Line 35, delete "1 12." and insert --112.--, therefor.

In Column 10, Line 41, delete "method" and insert --system--, therefor.

In Column 10, Line 44, delete "method" and insert --system--, therefor.

Signed and Sealed this
Thirty-first Day of January, 2012

David J. Kappos

David J. Kappos
*Director of the United States Patent and Trademark Office*